US005400481A

United States Patent [19]

Oda

[11] Patent Number: 5,400,481

[45] Date of Patent: Mar. 28, 1995

[54] SLIDE FOR SLIDE FASTENER

[75] Inventor: Kiyoshi Oda, Namerikawa, Japan

[73] Assignee: Yoshida Kogyo K.K., Tokyo, Japan

[21] Appl. No.: 147,585

[22] Filed: Nov. 5, 1993

[30] Foreign Application Priority Data

Nov. 16, 1992 [JP] Japan ..... 4-078710 U

[51] Int. Cl.[6] ..... A44B 19/30

[52] U.S. Cl. ..... 24/424

[58] Field of Search ..... 24/420, 421, 423, 424

[56] References Cited

U.S. PATENT DOCUMENTS 2,178,949 11/1939 Brozek ..... 24/423
2,839,806 6/1958 Moser .
4,074,399 2/1978 Kedzierski .

FOREIGN PATENT DOCUMENTS 0235653 9/1987 European Pat. Off. .
0492403 7/1992 European Pat. Off. .
561763 4/1957 Italy ..... 24/424
49-18732 5/1974 Japan .
1573998 9/1980 United Kingdom .

*Primary Examiner*—James R. Brittain
*Attorney, Agent, or Firm*—Hill, Steadman & Simpson

[57] ABSTRACT

A slider for slide fasteners which comprises a slider body with a guide channel, a shielding bracket slidably mounted thereon, a locking member interposed between the slider body and the bracket having a locking prong movable into and away from the guide channel and a spring member normally biasing the locking member into abutting engagement with the shielding bracket. The shielding bracket is generally U-shaped with spaced upper and lower arms 24 and 25 slidably received in guide grooves 19 and 30, respectively, formed in the slider body. A pull tab is pivotally connected to the shielding bracket for manipulating the slider to open and close a slide fastener. The locking member is completely shielded by the bracket against exposure from the slider body.

7 Claims, 4 Drawing Sheets

SLIDE FOR SLIDE FASTENER

BACKGROUND OF THE INVENTION

1. Field of the Invention

This invention relates to a slider for slide fasteners and more particularly such a slider which is provided with means for automatically locking the slider relative to the slide fastener.

2. Prior Art

Various automatically lockable sliders are known for use with a standard type of slide fastener having a cooperating pair of coupling element rows mounted on the front side of the fastener, or with a so-called "concealed" type of slide fastener having the coupling element rows mounted on the back side of the fastener such that the coupling elements are concealed or hidden from view when the fastener is fully closed. A typical example of slider for the latter type of slide fasteners is disclosed in Japanese Patent Publication No. 49-18732 in which the slider is provided with a locking member pivotably movable toward and away from a guide channel in the slider body. Since this locking member is exposed directly at the upper surface of the slider body, it is liable to get clogged with foreign matters or receive external stresses leading to malfunctioned slider.

Another type of automatic locking slider proposed in U.S. Pat. No. 2,839,806 has a U-shaped guide bracket along which a pull tab is movable such that the slider can be manipulated optionally from either side of the slide fastener. Since the bracket extends around and outwardly from the slider body, it presents a sort of obstacle to the user particularly when the slider is used only on one side of the fastener.

SUMMARY OF THE INVENTION

With the foregoing drawbacks of the prior art in view, the present invention seeks to provide a slider for use with a slide fastener of the type having mating rows of coupling fastener elements disposed on the back side of the fastener, which slider is relatively simple in construction and highly reliable in operation.

More specifically, the invention seeks to provide a slide fastener slider which has a relatively low profile with a locking member completely shielded against external interference.

The above and other objects and features of the invention will be better understood from the following detailed description taken with reference to the accompanying drawings.

According to the invention, a slider for slide fasteners which comprises a slider body including an upper wing plate and a lower wing plate joined at their one ends by a connecting neck to define therebetween a guide channel, a shielding bracket slidably mounted on the slider body, a pull tab pivotally connected to the bracket, and a locking member interposed between the shielding bracket and the slider body and having one of its ends resiliently movable into and away from the guide channel and the other end borne against the bracket.

DETAILED DESCRIPTION OF THE INVENTION

Figure 1:
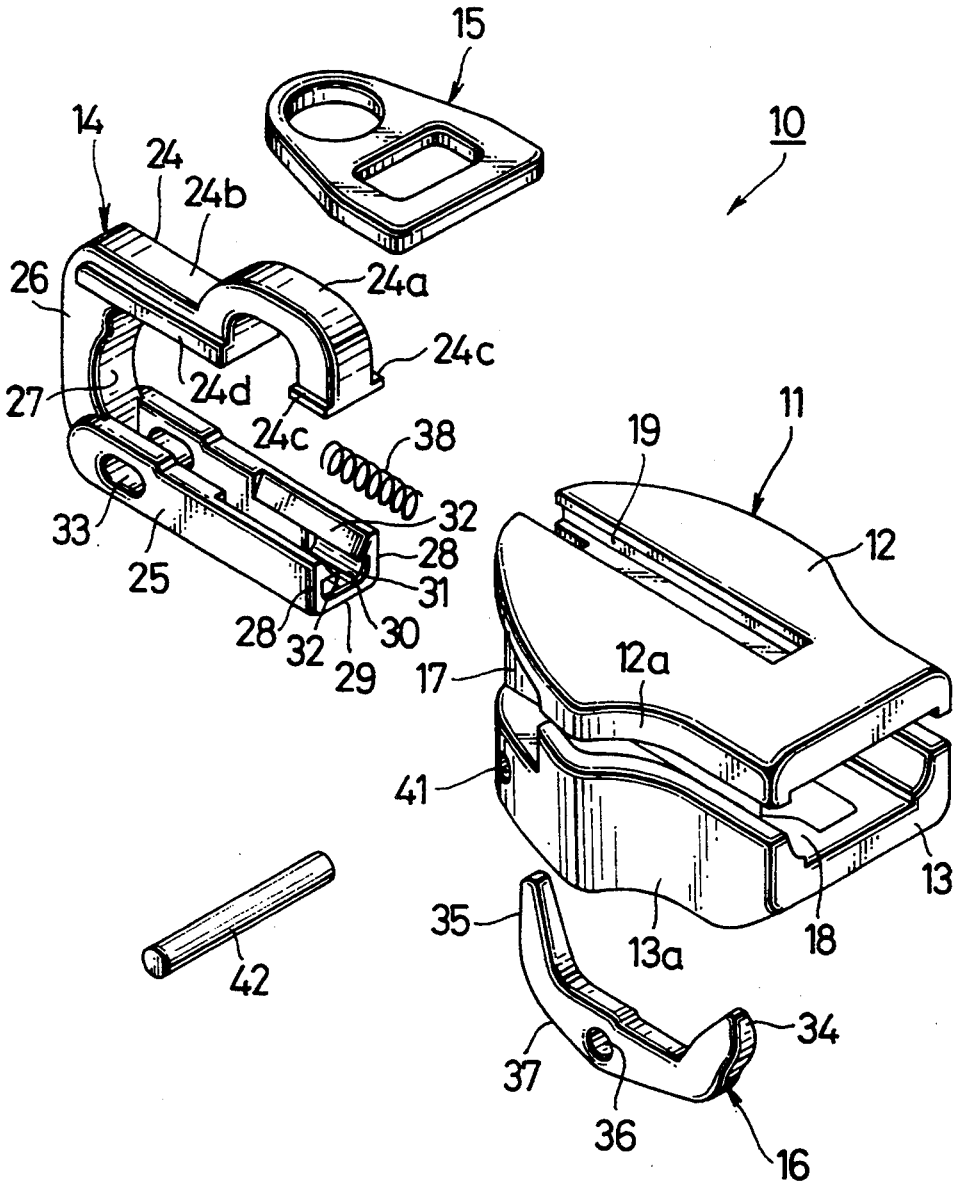
FIG. 1 is an exploded, perspective view of a slider embodying the invention.

Referring now to the drawings and FIG. 1 in particular, there is shown a slider 10 constructed in accordance with the principles of the invention, the slider 10 essentially comprising a slider body 11 including an upper wing plate 12 and a lower wing plate 13; a generally U-shaped shielding bracket 14; a pull tab 15; and a locking member 16.

Figure 6:
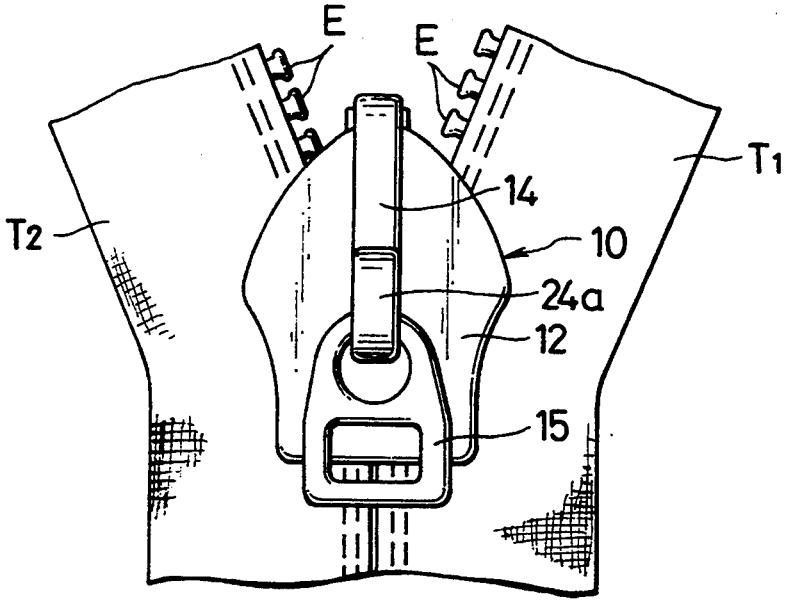
FIG. 6 is a segmentary front plan view of a slide fastener mounted with the slider.
Figure 7:
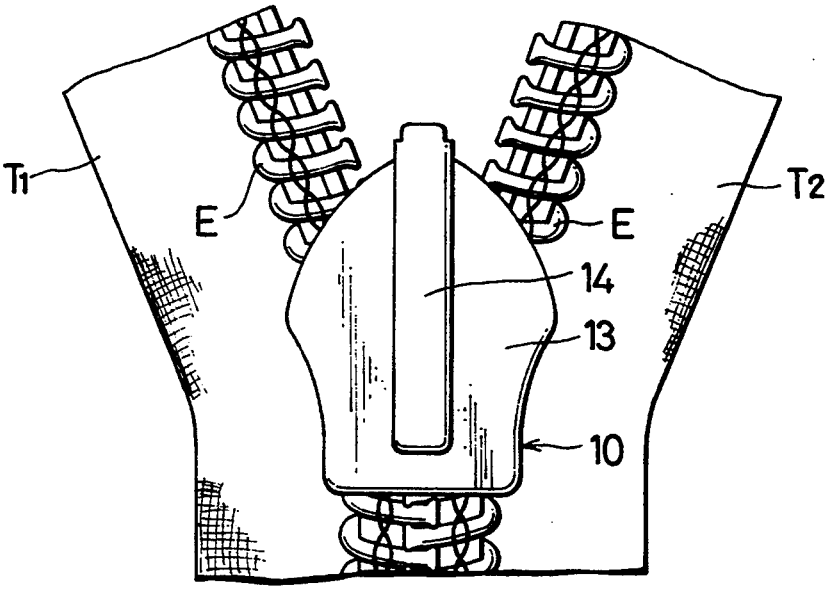
FIG. 7 is a segmentary reverse plan view of the same.

The upper and lower wing plates 12 and 13 have inwardly directed flanges **12*a* and 13*a*, respectively, which are spaced apart to permit the movement therethrough of a pair of fastener stringers T1 and T2 each carrying a row of coupling elements E along one of their longitudinal edges, the coupling elements E being shown in FIGS. 6 and 7** to be of a continuous helical structure for purposes of illustration.

The wing plates 12 and 13 are joined at one or front end of the slider body 11 by a connecting neck 17 commonly known as a diamond so as to define a generally Y-shaped guide channel 18 for the passage of the stringers T1 and T2 in a manner well known in the art.

The upper wing plate 12 is provided in its upper surface with a longitudinally elongated dovetail guide groove 19 which extends at one end clear through and beyond the connecting neck 17 and terminates at the other end short of the rear end of the slider body 11.

Figure 4:
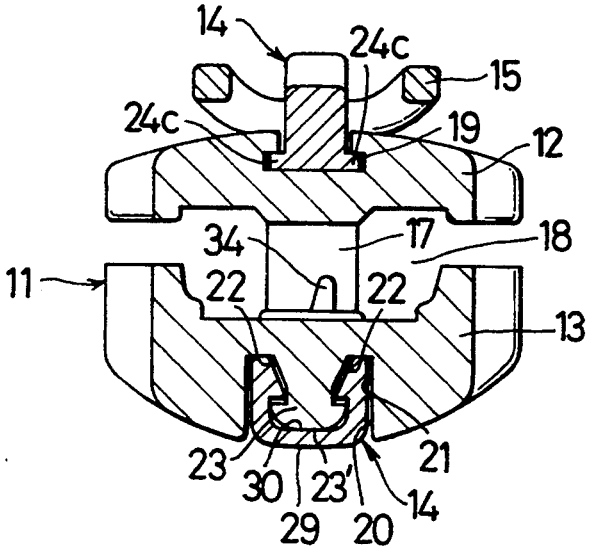
FIG. 4 is a cross-sectional view taken on the line IV—IV of FIG. 3.
Figure 5:
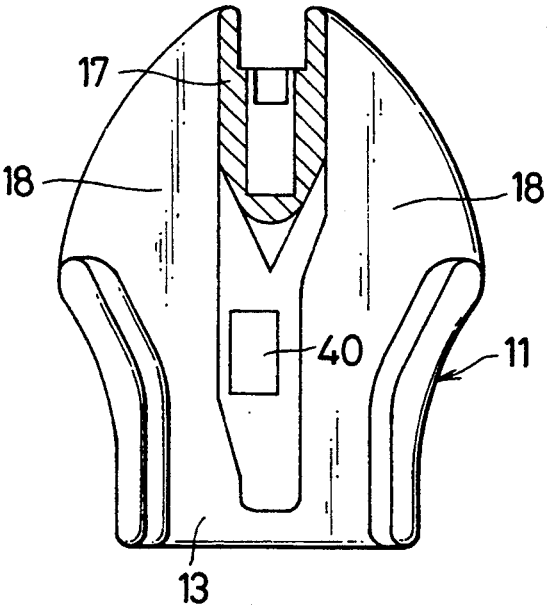
FIG. 5 is a top plan, partially sectional, view of a lower wing plate of the slider.

The lower wing plate 13 is provided in its bottom surface with a longitudinally elongated guide groove 20 which is cross-sectionally polygonal as defined jointly by straight vertical parallel walls 21, downwardly tapered walls 22 and a laterally bulged head 23 as better shown in FIG. 4. The head 23 has a flat surface 23' lying at a level slightly above the lowermost bottom surface of the lower wing plate 13. A through-opening 40 is formed, extending through the guide groove 20 of the lower wing plate 13 in communication with the guide channel 18. A through-hole 41 is formed, extending transversely through the lower wing plate 13 adjacent to the neck 17 of the slider body 11.

The shielding bracket 14 is generally U-shaped, having an upper arm 24 and a lower arm 25 joined at their one ends by a vertical neck 26 with an arcuate inner surface 27 so as to hold the two arms 24, 25 spaced apart by a distance determined to ensure proper mounting of the bracket 14 on the slider body 11 in a manner hereafter to be described. The upper arm 24 includes an arc-shaped trunnion **24*a* for receiving the pull tab 15 pivotally thereon and a flat horizontal portion 24*b* merging with one end of the trunnion 24*a*. A short lateral ridge 24*c* is formed on each of opposite sides of the trunnion 24*a* at a free end thereof, and a long lateral ridge 24*d* is formed on each of opposite sides of the horizontal portion 24*b*, the short ridges 24*c* and the long ridges 24*d* being aligned with each other and adapted to slidably engage with the dovetail guide groove 19 in the upper wing plate 12 of the slider body 11 as better shown in FIG. 4**.

The lower arm 25 has upwardly directed side flanges 28 and a flat base 29 jointly defining therewith a cross-sectionally polygonal elongated guide groove 30 complimentary in shape with the guide groove 20 in the lower wing plate 13 of the slider body 11 and is provided with a widened U-shaped laterally offset recess 31 configured to snugly receive the bulged head 23 of the lower wing plate 13 and upwardly flared walls 32 engageable with the corresponding tapered walls 22 of the lower wing plate 22 such that the lower arm 25 slidably engages with the lower wing plate 22, with the flat base 29 lying substantially flush with the lowermost surface of the lower wing plate 13 as shown in FIG. 4. A pair of horizontally elongated or oblong guide slots 33 are formed, extending in alignment transversely across the side flanges 28, 28 adjacent to the vertical neck 26 of the shielding bracket 14.

The locking member or lever 16 has an upwardly projecting locking prong 34 at one end and an upwardly extending abutting lug 35 at the opposite end with a circular slot 36 formed in the mid part of a horizontal base 37.

Figure 2:
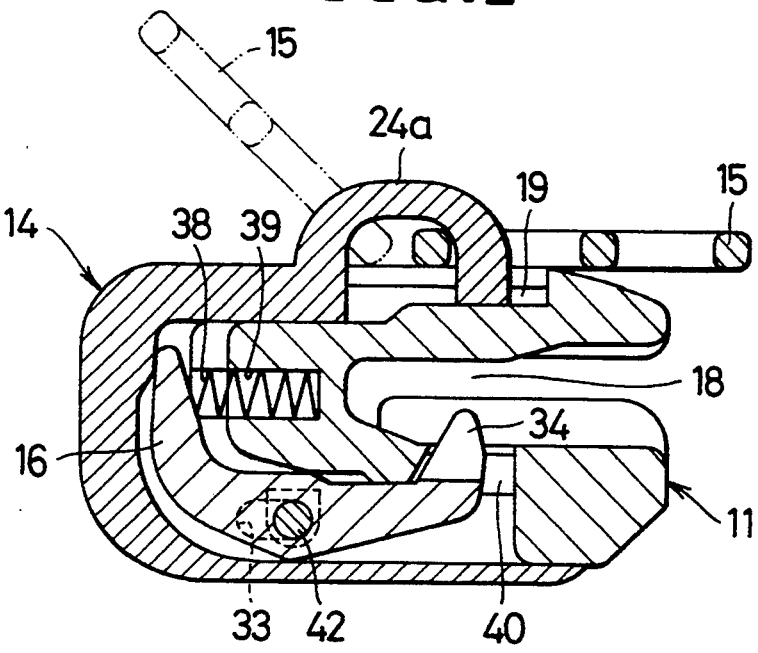
FIG. 2 is a longitudinal cross-sectional view of the same shown in locked position.
Figure 3:
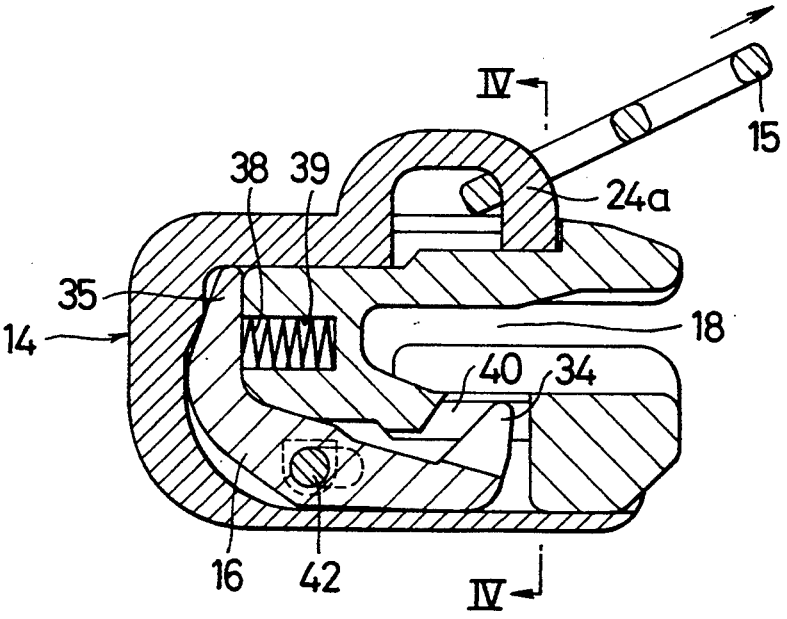
FIG. 3 is a view similar to FIG. 2 but showing the slider in unlocked position.

Designated at 38 is a spring member accommodated in a horizontal bore 39 formed in the neck 17 of the slider body 11 and normally biased into abutting engagement with the abutting lug 35 of the locking member 16 which is in turn borne against the arcuate inner surface 27 of the shielding bracket 14 as shown in FIGS. 2 and 3.

The slider 10 thus constructed is assembled by mounting the spring 38, the locking member 16 and the shielding bracket 14 with the pull tab 15 in this order in place on the slider body 11, in which instance the slot 36 of the locking member 16 and the slots 33, 33 are registered with the through-hole 41 of the slider body 11 and interconnected by a pintle 42. The slider 10 thus assembled is mounted in turn on the pair of stringers T1, T2 with its pull tab side flipped on the reverse face of the fastener as shown in FIG. 6, so that when the pull tab 15 is manipulated to move the slider 10 in a direction to close the fastener, the rows of coupling elements E thereon are progressively coupled together and concealed from view.

FIG. 3 illustrates the closing operation of the slider 10 in which the pull tab 15 is pulled in the direction of the arrow, viz. rightward as viewed in the drawings, whereupon the shielding bracket 14 slides in the same direction relative to the slider body 11 along the guide grooves 19, 20 for a linear distance corresponding to the length of the oblong guide slot 33 in which the pintle 42 is received. This sliding movement of the bracket 14 causes the locking member 16 to tilt about the pintle 42 against the tension of the spring 38 so that the locking prong 34 is retracted through the opening 40 from the guide channel 18 to release the coupling elements E.

FIG. 2 shows the pull tab 15 flipped flat against the slider body 11 upon closure of the fastener with the locking prong 34 urged by the action of the spring 38 into the guide channel 18 to engage between adjacent coupling elements E thereby locking the slider 10 relative to the fastener. The opening operation of the slider 10 is effected by rotating the pull tab 15 counter-clockwise to the phantom line position and pulling it in the opposite direction, viz. leftward as viewed in the drawings.

Obviously, various modifications and variations of the present invention are possible in the light of the above teaching. It is therefore to be understood that within the scope of the appended claims the invention may be practiced otherwise than as specifically described.

What is claimed is:

1. A slider for slide fasteners which comprises a slider body including an upper wing plate and a lower wing plate joined at their one ends by a connecting neck to define therebetween a guide channel, a shielding bracket slidably mounted on said slider body, a pull tab pivotally connected to said bracket, and a locking member interposed between said shielding bracket and said slider body and having one of its ends resiliently movable into and away from said guide channel and the other end borne against said bracket said shielding bracket mounted to said slider body substantially flushly with a lowermost surface of said lower wing plate.

2. A slider according to claim 1 further including a spring member normally biasing said locking member against said shielding bracket.

3. A slider according to claim 1 wherein said shielding bracket has an oblong guide slot having a length corresponding to a linear distance over which said bracket is movable relative to said slider body.

4. A slider according to claim 1 wherein said shielding bracket is of a substantially U-shaped configuration defined by an upper arm and a lower arm which are slidably mounted on said upper wing plate and said lower wing plate, respectively, said lower arm having a base lying substantially flush with the lowermost surface of said lower wing plate.

5. A slider for slide fasteners which comprises a slider body including an upper wing plate and a lower wing plate joined at their one ends by a connecting neck to define therebetween a guide channel, a shielding bracket slidably mounted on said slider body, a pull tab pivotally connected to said bracket, and a locking member interposed between said shielding bracket and said slider body and having one of its ends resiliently movable into and away from said guide channel and the other end borne against said bracket; and wherein said shielding bracket and said locking member are connected by a common pintle to said slider body.

6. A slider according to claim 5 wherein said shielding bracket has an oblong guide slot having a length corresponding to a linear distance over which said bracket is movable relative to said slider body; and said pintle is received into said guide slot.

7. A slider according to claim 6 wherein said shielding bracket is of a substantially U-shaped configuration defined by an upper arm and a lower arm which are slidably mounted on said upper wing plate and said lower wing plate, respectively, said lower arm having a base lying substantially flush with the lowermost surface of said lower wing plate.

* * * * *